US005985774A

United States Patent [19]

Capel

[11] Patent Number: 5,985,774

[45] Date of Patent: Nov. 16, 1999

[54] RUG INCLUDING A SCENTED FILAMENT INCORPORATED THERIN AND METHOD THEREFOR

[76] Inventor: S. Kea Capel, 831 N. Main St., Troy, N.C. 27371

[21] Appl. No.: 08/859,512

[22] Filed: May 20, 1997

[51] Int. Cl.[6] ..... B32B 7/00; D02G 3/00

[52] U.S. Cl. ..... 442/96; 428/37; 428/905

[58] Field of Search ..... 428/37, 905; 442/96, 442/301

[56] References Cited

U.S. PATENT DOCUMENTS

| | | | |
|---|---|---|---|
| Re. 32,713 | 7/1988 | Woo | 442/96 |
| 1,270,055 | 6/1918 | Richards | 442/96 |
| 2,108,705 | 2/1938 | Broadwin | 66/8 |
| 2,468,870 | 5/1949 | Eskow | 66/9 A |
| 3,344,699 | 10/1967 | Ohno | 428/37 X |
| 4,254,179 | 3/1981 | Carson, III et al. | 428/95 X |
| 4,514,461 | 4/1985 | Woo . | |
| 4,528,226 | 7/1985 | Sweeny | 442/96 X |
| 4,604,114 | 8/1986 | Ward | 428/905 X |
| 4,713,291 | 12/1987 | Sasaki et al. | 428/905 X |
| 4,882,220 | 11/1989 | Ono et al. | 442/96 |
| 4,908,252 | 3/1990 | Carnahan et al. | 442/96 |
| 4,917,920 | 4/1990 | Ono et al. | 427/389.9 |
| 5,206,080 | 4/1993 | Tashiro et al. | 442/200 |
| 5,381,984 | 1/1995 | Hindsgual | 428/43 X |
| 5,617,743 | 4/1997 | Rednour | 66/9 A |

*Primary Examiner*—Deborah Jones
*Assistant Examiner*—Jason Savage
*Attorney, Agent, or Firm*—Kennedy Covington Lobdell & Hickman

[57] ABSTRACT

A scented rug has a plurality of formed textile length portions disposed side-by-side with adjacent length portions secured together to form the rug. At least one of the length portions includes a scented strand extending lengthwise therein. The length portions can be formed by knitting, braiding, or wrapping in which embodiments the scented strand is covered by the textile material of the length portions. Alternatively, the rug is woven with the scented strand included in the warp or filling. The invention includes the methods of forming the rugs.

20 Claims, 7 Drawing Sheets

RUG INCLUDING A SCENTED FILAMENT INCORPORATED THERIN AND METHOD THEREFOR

FIELD OF THE INVENTION

The present invention relates to scented rugs and, in particular, to area rugs having a scented strand extending through at least part of the rug for providing a pleasing aroma to a room in which the rug is used.

BACKGROUND OF THE INVENTION

Currently, scented carpets, curtains, bed mattresses, and other household items are known for providing a pleasant aroma to a room in which the household item is used. Such scented items are formed or manufactured in part from a fabric that has been impregnated with fragrance capsules which, upon release of the chemical fragrance by the capsule, introduces the pleasing fragrance into the environment. For example, in Woo, U.S. Pat. No. RE 32,713, a fabric is impregnated with micron-size bubbles in the form of fragile capsules within the interstices between the strands of the fabric. A similar technique is employed in Ono et al., U.S. Pat. No. 4,917,920.

Alternatively, it is also known from Tashiro et al., U.S. Pat. No. 5,206,080, and Sasaki et al., U.S. Pat. No. 4,713,291, to utilize fibers in the range of 3 mm to 150 mm that include fragrance-carrying material in, for example, the making of a woven or knitted fabric or the formation of a sheet-like web. However, the costs associated with the impregnation of fragile capsules within a fabric or the manufacture of staple fibers having fragrance-carrying material therein can be prohibitive, and a need exists for a scented rug that can be easily and relatively inexpensively produced without any special treatment.

SUMMARY OF THE PRESENT INVENTION

The present invention comprises a rug that is inexpensively scented with a pleasant fragrance by the introduction of one or more scented strands into the rug during its manufacture. Generally, the rug comprises a plurality of length portions of textile material disposed side-by-side one another, with adjacent length portions being secured together to form the rug. When at least one of the length portions is formed, a scented strand carrying a fragrance emitting chemical is introduced into the forming process so that the length portion is actually formed about the scented strand. Thus, a scented strand extends in lengthwise direction through at least one length portion. Moreover, the textile material of the length portion covers the scented strand thereby hiding the scented strand from view, but the textile material nevertheless allows the fragrance carried by the scented strand to pass therethrough into the environment for providing a pleasant aroma to the room in which the rug is used.

Features of the present invention include: the scented strand extending substantially the entire length of a length portion; the strand including a continuous filament that extends substantially the length of all of the length portions; and all of the length portions being integrally formed lengthwise to define a single length disposed to form the side-by-side disposed and secured length portions forming the rug.

Preferably the scented strand is formed of low density polyethylene which contains a fragrance emitting chemical. Moreover, each length portion preferably forms an interior core and includes as one core component conventional filler material extending along the length thereof. At least one of the length portions also includes as a core component the scented strand which extends together with the filler material through the length portion.

In one embodiment of the present invention the length portions are formed of knitted tubular material which covers the scented strand and filler material. In an alternative embodiment the length portions are formed of material that is wrapped about the scented strand and filler material. In yet another alternative embodiment the length portions are formed of braided material having two cores with the filler material forming a core component in each core and with the scented strand forming a core component in at least one of the cores of one of the braided length portions. Moreover, the braided material is preferably formed as a three-ply braid. Yet in another embodiment the scented strand itself is woven together with textile material as either a warp yarn or a filling yarn to form a rug.

The present invention also includes methods of introducing a scented strand into a rug during its manufacture. Specifically, the present invention includes the disposition of a length of a scented strand within a rug, including the forming of a plurality of length portions of textile material; the disposing of a length of scented strand lengthwise within at least one of the length portions for covering of the strand; and the securing of the plurality of length portions side-by-side to form the rug. Furthermore, the step of disposing includes forming a length portion of textile material about a length of a continuous polyethylene strand that includes a fragrance emitting chemical such as by knitting, braiding and wrapping. The method of the present invention also includes weaving textile material together with a length of a continuous strand as a warp yarn and alternatively as a filling yarn, the strand carrying a fragrance emitting chemical.

DETAILED DESCRIPTION OF THE EMBODIMENTS OF THE PRESENT INVENTION

Figure 1:
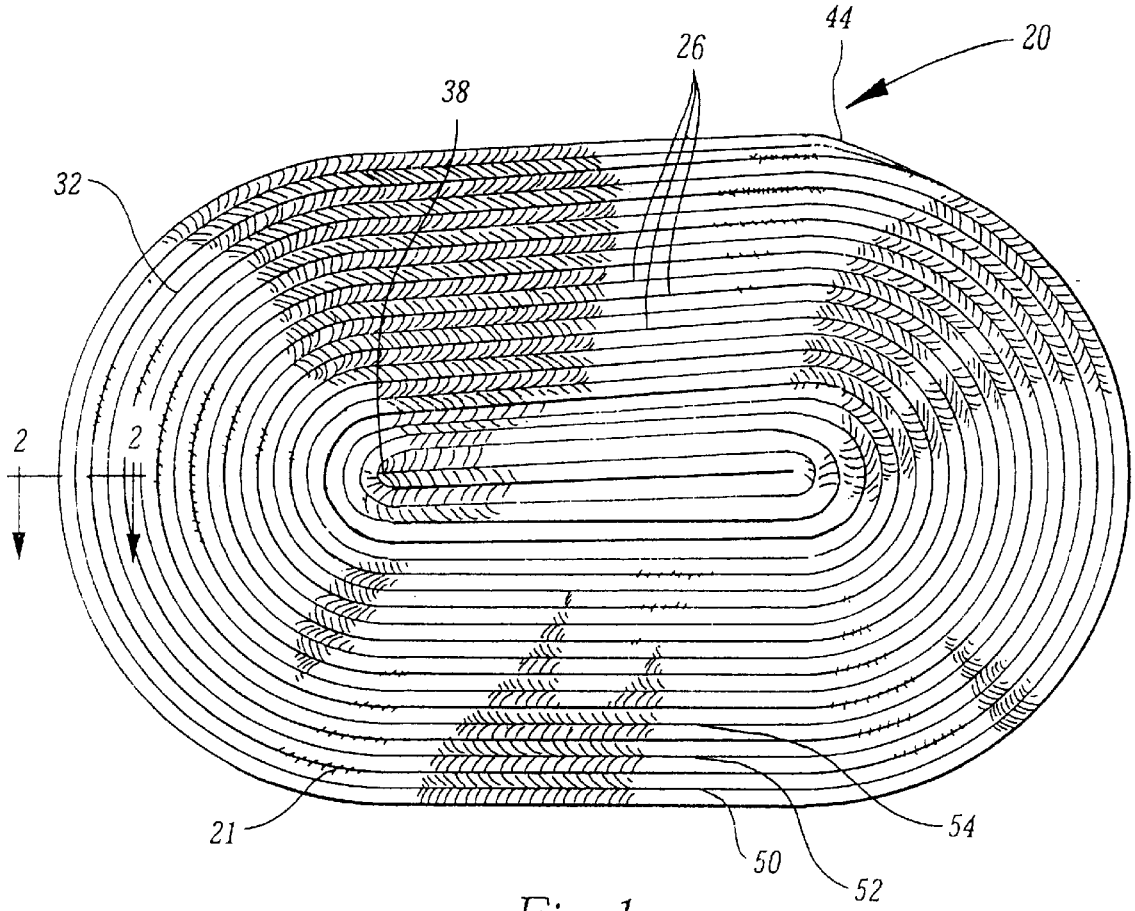
FIG. 1 is a perspective view of a rug according to one of the preferred embodiments of the present invention in which the length portions are formed by braiding.
Figure 2:
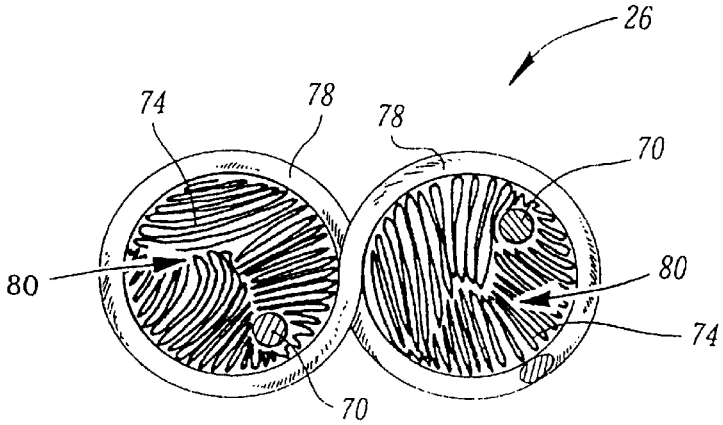
FIG. 2 is a perspective cross-sectional view of a length portion of the rug of FIG. 1.
Figure 3:
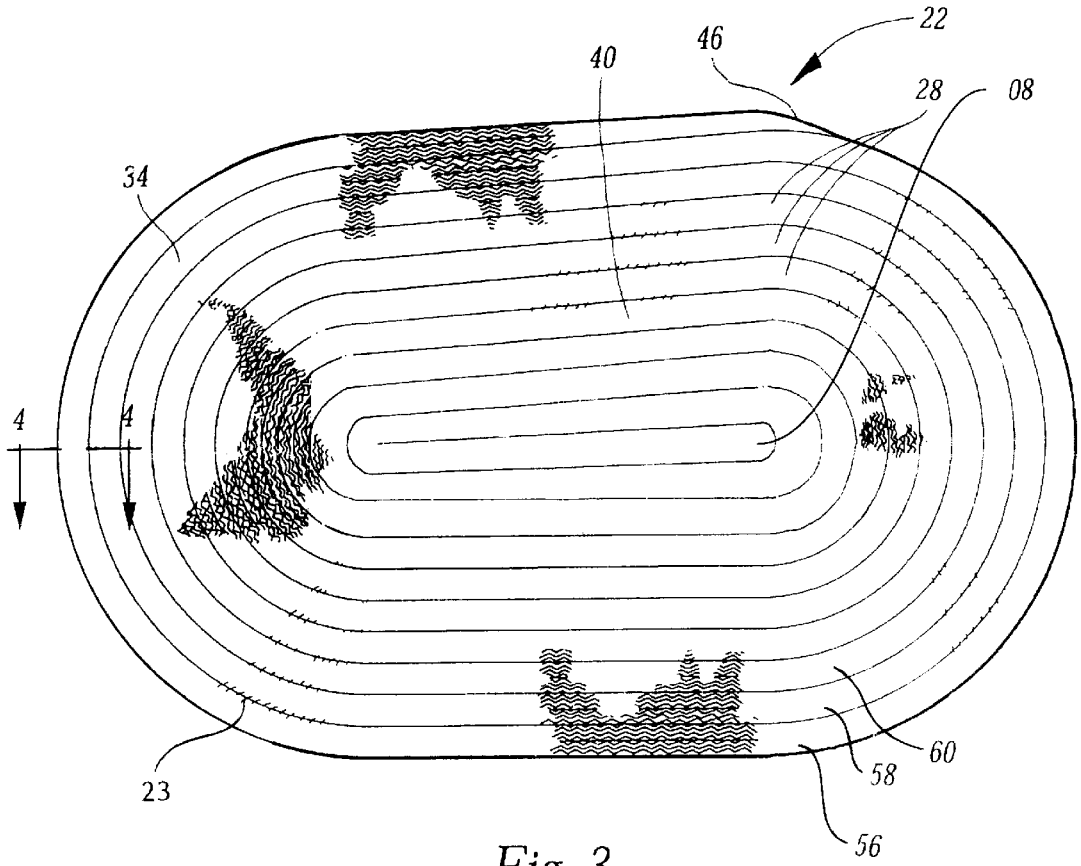
FIG. 3 is a perspective view of another preferred embodiment of a rug of the present invention in which the length portions are formed by knitting.
Figure 4:
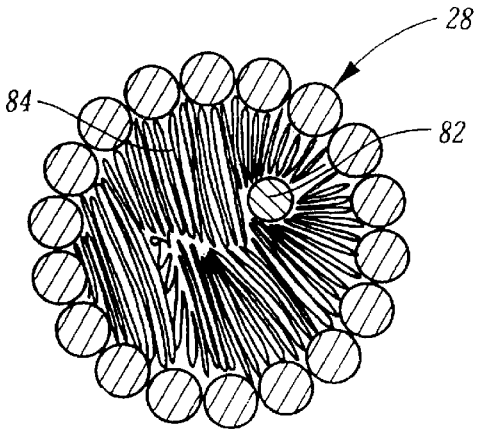
FIG. 4 is a cross-sectional view of a length portion of the rug of FIG. 3.
Figure 5:
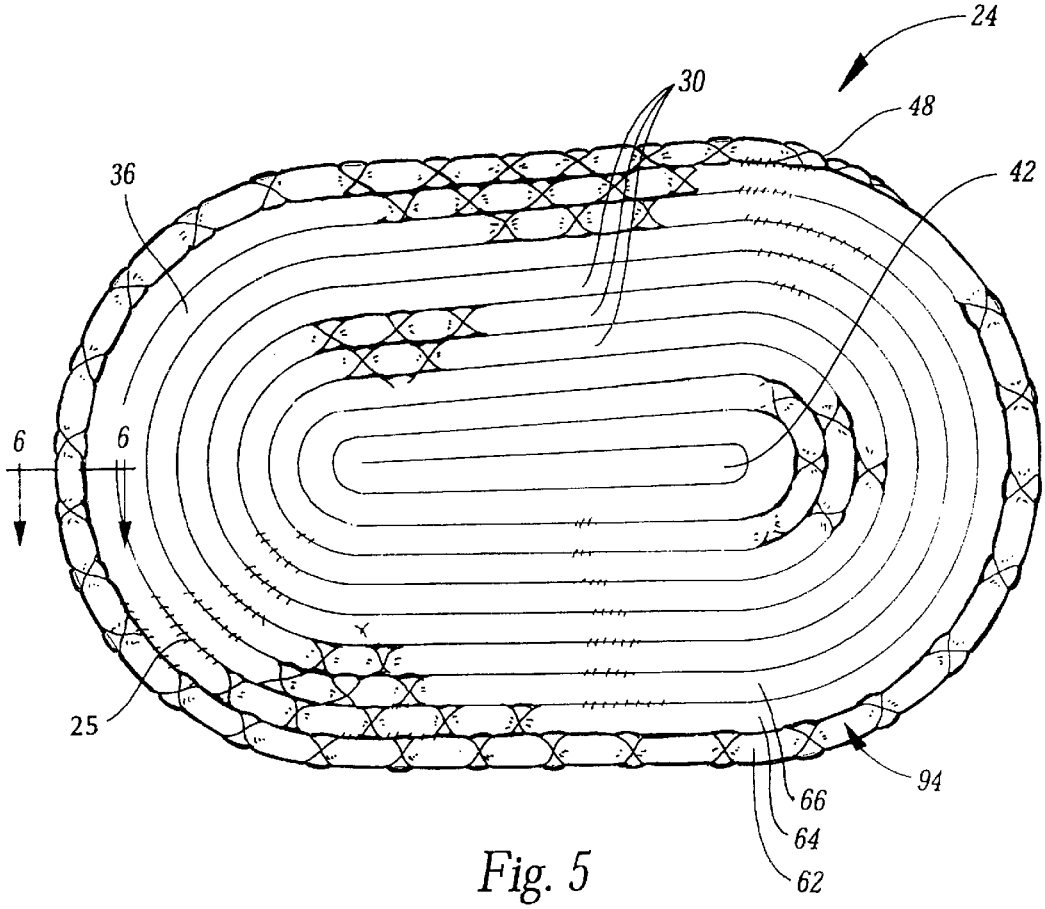
FIG. 5 is a perspective view of yet another preferred embodiment of the rug of the present invention in which the length portions are formed by wrapping.
Figure 6:
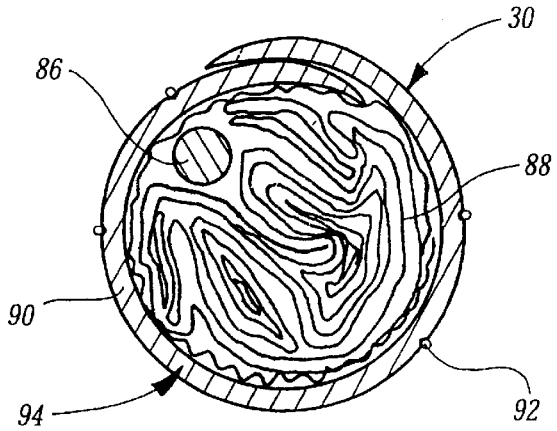
FIG. 6 is a cross-sectional view of a length portion of the rug of FIG. 5.

Referring initially to FIGS. 1–6, three of the preferred embodiments 20,22,24 of the rug of the present invention are shown each having respectively a plurality of length portions 26,28,30 of textile material. Preferably, the length portions 26 that form rug 20 (FIG. 1) are tubular lengths of braided yarn, and the length portions 28 that form rug 22 (FIG. 3) are knitted yarn, with each of the respective length portions 26,28 including conventional filler material therein as a core component, as more fully explained below. Alternatively, the length portions 30 that form rug 24 (FIG. 5) of the present invention are formed by wrapping textile material about the filler material and securing the wrap by threads spiraled about the wrapped material, also as more fully explained below. Furthermore, the length portions 26,28,30 of each respective rug 20,22,24 are each preferably formed of one continuous length wherein the length portions 26,28,30 are integrally formed lengthwise to define a respective length 32,34,36 that is preferably wound about itself in a conventional manner to form the rugs 20,22,24 of the respective embodiments. In particular, one end 38 of length 32 forming rug 20, one end 108 of length 34 forming rug 22, and one end 42 of length 36 forming rug 24 begins within the interior of each respective rug 20,22,24 and the respective length 32,34,36 is spirally wound thereabout so that the other end 44 of length 32, end 46 of length 34, and end 48 of length 36 lies on the outer boundary of the respective rug 20,22,24. Thus, for instance, outer length portions 50,52,54 of length 32, outer length portions 56,58,60 of length 34, and outer length portions 62,64,66 of length 36 are respectively disposed and secured adjacent one another in a spiral configuration to form the outer boundary of each respective rug 20,22,24 as respectively shown in FIGS. 1, 3, and 5. Conventional stitching 21,23,25 is used to secure adjacent length portions in each respective rug 20,22,24 together.

Regardless of the method of forming the length portions 26,28,30 of each of the respective rugs 20,22,24, i.e., either by braiding, knitting, or wrapping, each length portion thereof includes, in addition to or in place of conventional filler material, a scented strand extending therethrough. The strand of the present invention preferably is a low density polyethylene semi-rigid cord that is commercially available from Petco incorporated of Grand Rapids, Mich., supplied in a coil configuration within a container. However, any desired scented strand or cord may be used in accordance with the present invention.

Figure 9:
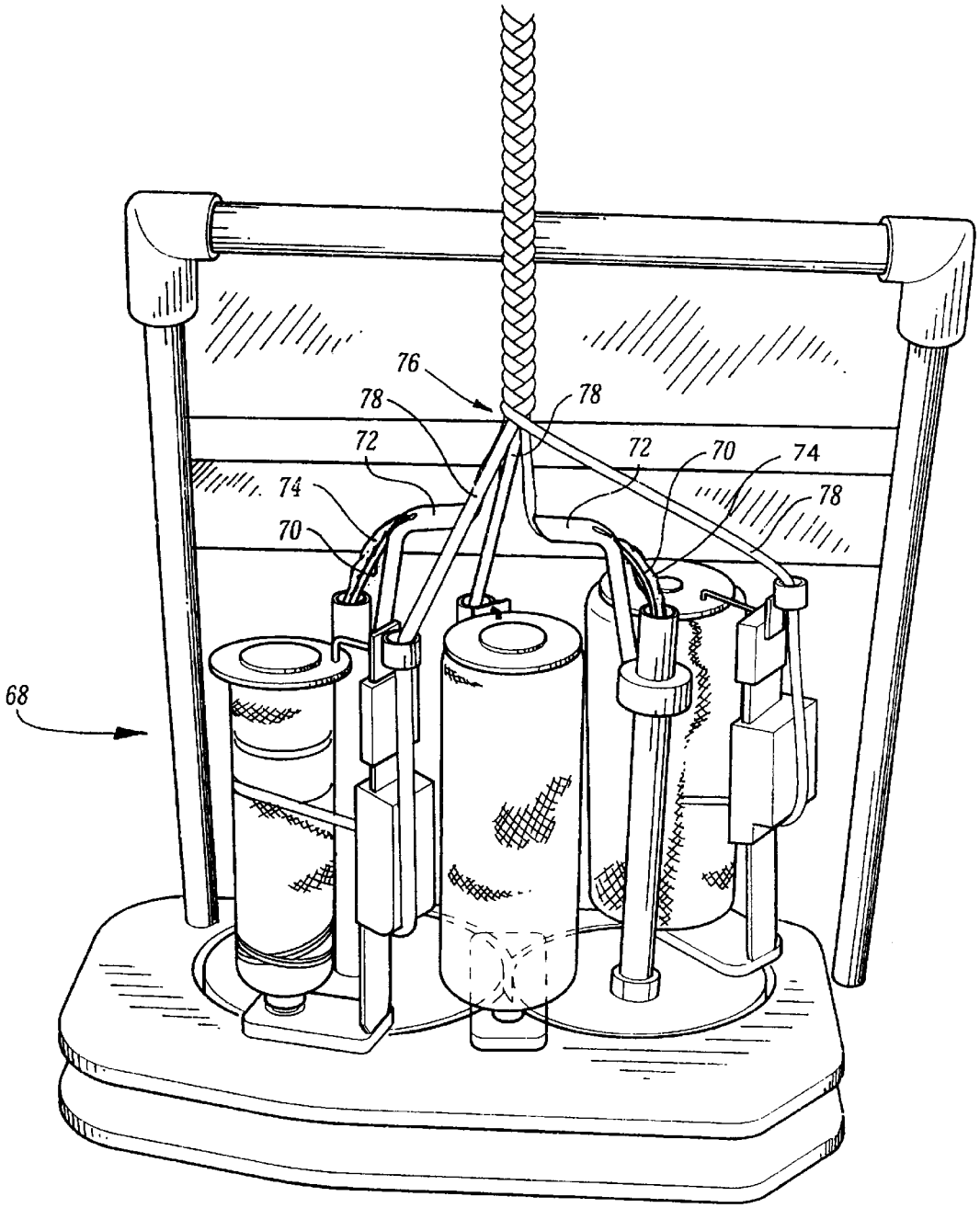
FIG. 9 is a view illustrating the manufacturing of a braided length portion about two scented strands.

Specifically, the scented strand is disposed within each of the length portions 26,28,30 of the rugs 20,22,24 preferably by forming each of the length portions 26,28,30 about the scented strand, as is done with respect to filler material found in conventional braided, knitted, and wrapped rugs. For example, with respect to the length portions 26 of the braided rug 20, each length portion 26 is preferably formed in a yarn braiding process in a conventional three-ply braid machine 68 as shown in FIG. 9. In particular, two scented strands 70 are preferably inserted through conventional guide tubes 72 along with conventional filler material 74 to arrive at a braiding location 76 whereat three yarns 78 are braided. A braid is thereby formed directly about the filler material 74 and the scented strands 70, with the three-ply braiding machine 68 braiding the yarn 78 about two separate lines of filler material 74 and scented strands 70 to form each braided length portion 26 with two identical cores 80. The scented strands 70 are stored in respective containers in coil configuration below the three-ply braiding machine 68 and each strand 70 is drawn into the braiding machine 68 in the conventional manner that the filler material 74 is drawn into the braiding machine 68.

With respect to the length portions 28 of rug 22 which are formed on a conventional knitting machine, the scented strand 82 thereof is also drawn into the knitting machine in the conventional manner that the filler material 84 is drawn into the knitting machine, with the knitting being performed by the machine about the filler material 84 and the scented strand 82. Furthermore, the scented strand 82 is also preferably stored in coil configuration in a container and is placed on the floor below the knitting machine.

With respect to the length portions 30 of rug 24 which are formed by wrapping, the scented strand 86 thereof is drawn into the wrapping machine in the same conventional manner that the filler material 88 thereof is drawn into the wrapping machine, and the fabric 90 forming the length portions 30 is wrapped about the filler material 88 and the scented strand 86 and secured in its wrapped configuration by thread 92 spiraled about the wrap 94 in conventional manner. Again, the scented strand 86 is preferably stored in coil configuration in a container and is placed on the floor below the wrapping machine and is drawn out of the container into the wrapping machine in the conventional manner that the filler material 88 is drawn into the wrapping machine.

One benefit of the preferred scented strand of the present invention is that, because the scented strand is able to be stored in coil configuration in a container below each rug-producing machine, a container of the scented strand may be conveniently used from the container in which it is received from a supplier without any intermediate handling or rearranging and can be readily transported from one textile machine to another textile machine as needed. Moreover, the scented length portions of the present invention may be made without any substantial modification to the conventional textile machines which are used to manufacture the rugs.

Figure 7:
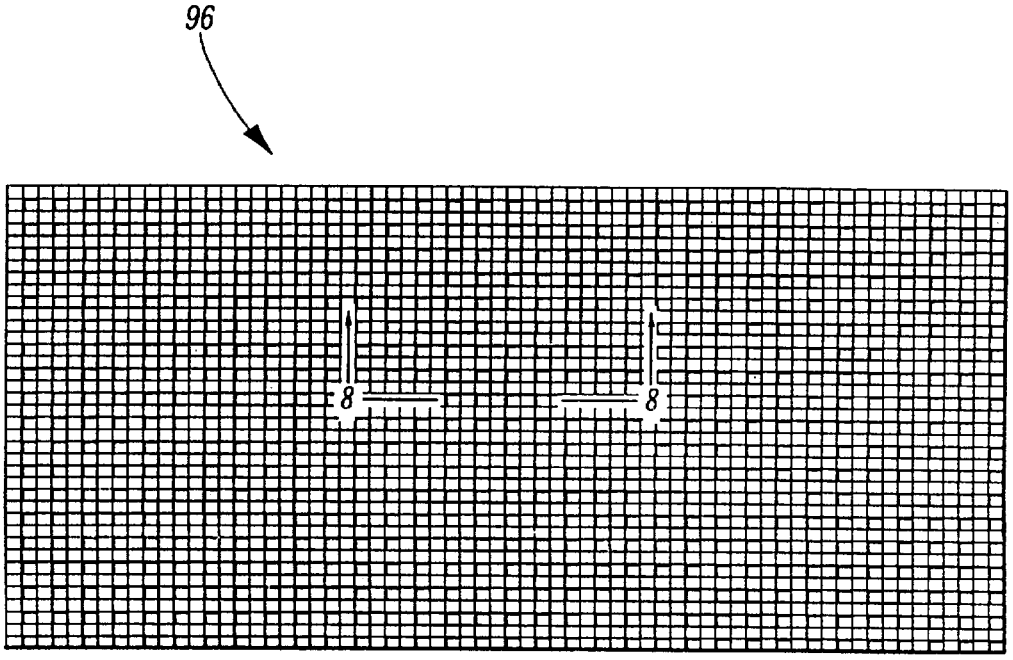
FIG. 7 is a perspective view of an additional preferred embodiment of the rug of the present invention in which the rug has been woven with scented strands.
Figure 8A:
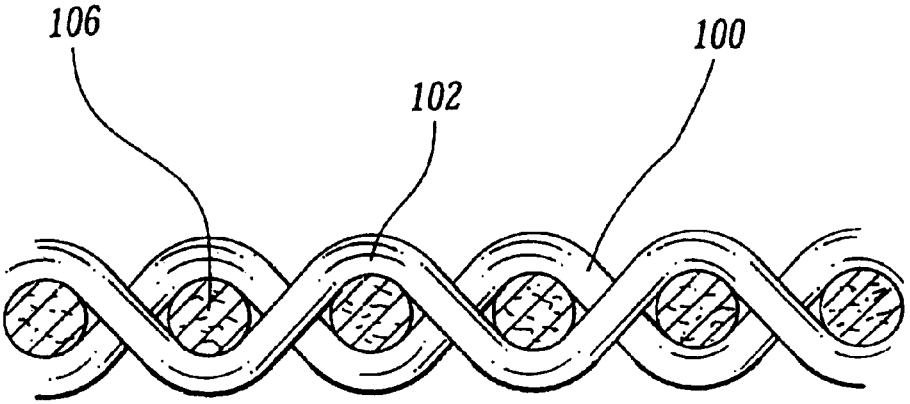
FIG. 8*a* is a cross-sectional view of the rug of FIG. 7.
Figure 8B:
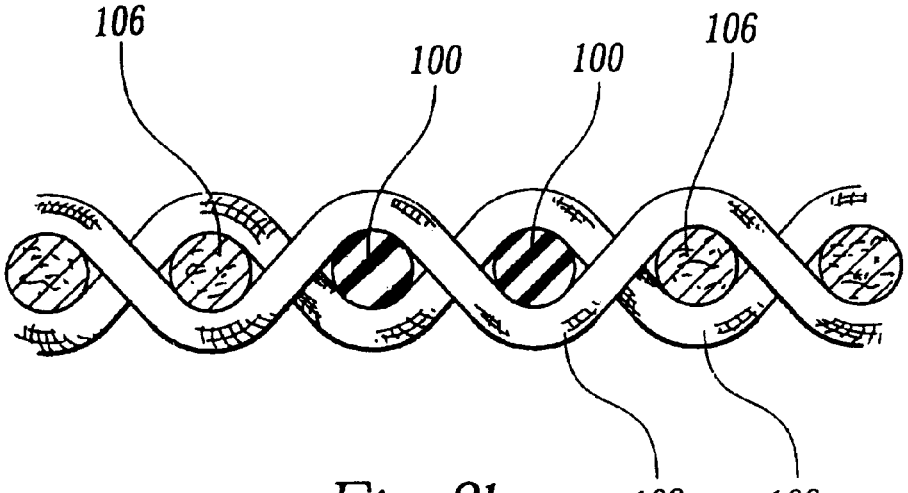
FIG. 8*b* is a cross-sectional view of another woven rug.
Figure 10:
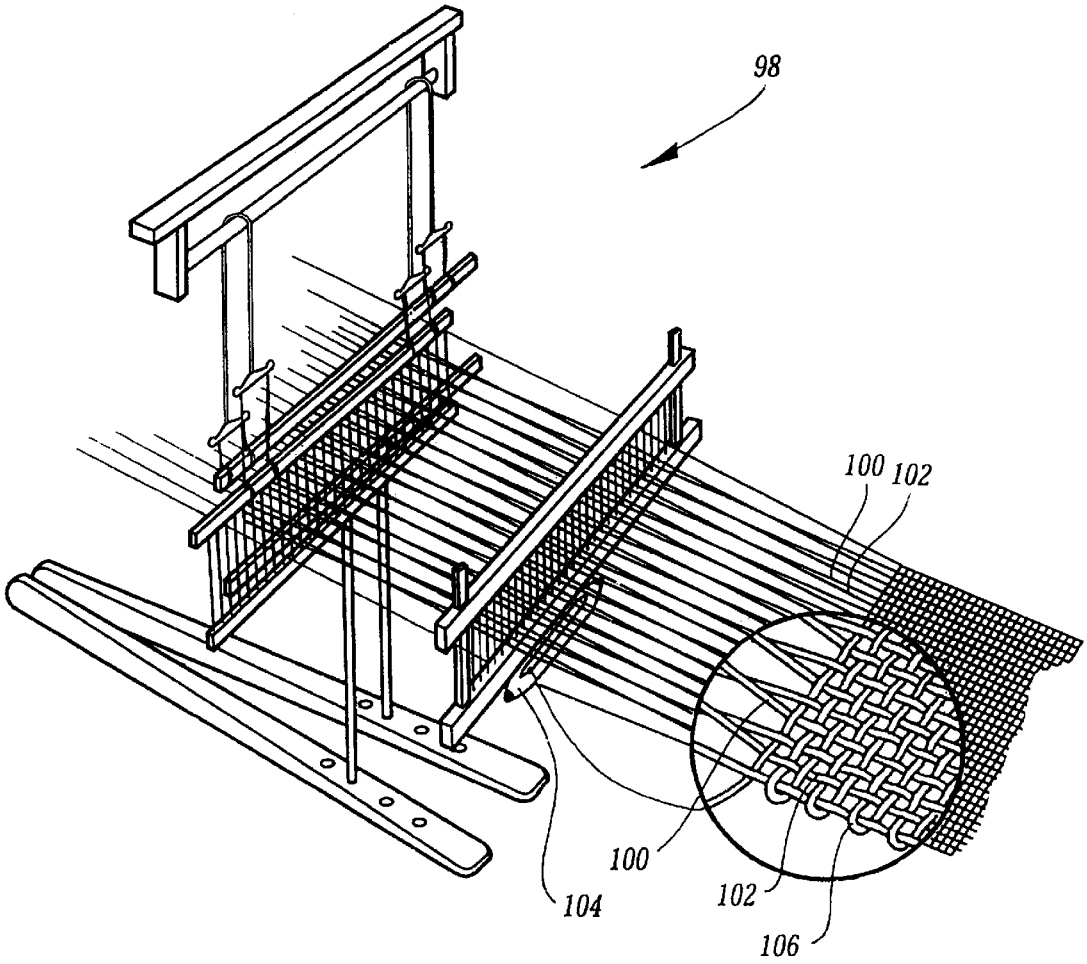
FIG. 10 is a view illustrating the weaving of yarns together with scented strands to form a rug.

In yet another embodiment of the rug of the present invention, a rug 96 (FIG. 7) is formed by weaving on a conventional loom 98, with the scented strand 100 thereof being fed into the loom 98 as a warp yarn along with the conventional warp yarns 102 as shown in FIG. 10. In a crosssection of the rug 96 taken along the line 8—8 shown in FIG. 8*a*, the scented strand 100 is illustrated in the place of one of the warp yarns 102. In an alternative embodiment of the woven rug 96, the scented strand 100 is fed from a bobbin on a shuttle 104 for weaving like the filling yarns 106 and results in the rug cross-section shown in FIG. 8*b*. The scented strand 100 in the woven rug 96 of the present invention can therefore be woven either like warp yarns 102 (FIG. 10) or filling yarns 106.

In the embodiments of the rug of the present invention which include length portions covering and enclosing the scented strand, the strand is preferably incorporated throughout all of the length portions which form the rug. However, if the fragrance emitted by the rug thereby formed is too dominant, the strand may be disposed in less than all of the length portions forming the rug to thereby decrease the strength of the fragrance. Moreover, in embodiments wherein the rug is formed by weaving, the number of warp ends of the scented strand or the number of filling ends of the scented strand may be varied to obtain the desired strength of the fragrance.

Thus, as will now be readily apparent to one skilled in the art, the present invention provides a scented rug and a method for inexpensively manufacturing a scented rug with no substantial modification to conventional textile machinery. Moreover, the preferred scented strand need not be manufactured or produced by the rug manufacturer, but rather is commercially available to the rug manufacturer in coil form in convenient containers ready for use in manufacturing scented rugs, thus further facilitating the practicing of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A rug comprising a plurality of length portions formed of textile material, each said length portion extending at least a respective length between two opposed sides of the rug, said length portions being disposed side-by-side with adjacent length portions being secured together to thereby form the rug, at least one of said length portions defining a core within which a scented filament extends and is covered by said textile material, said scented filament having a length equal to at least a substantial portion of said respective length of said length portion within which said scented filament is disposed.

2. A rug according to claim 1, wherein said scented filament of said at least one length portion extends substantially the entire said respective length of said length portion.

3. A rug according to claim 2, wherein all said length portions are integrally formed lengthwise to define a single length disposed to form said side-by-side disposed and secured length portions, and wherein said length of said scented filament substantially equals said single length, said scented filament extending through all said length portions.

4. A rug according to claim 1, wherein said scented filament is formed of polyethylene containing a fragrance emitting chemical.

5. A rug according to claim 1, wherein each said length portion defines an interior core and includes filler material disposed therein and extending the length thereof, and said scented filament extends with said filler material within said at least one said length portion.

6. A rug according to claim 3, wherein said scented filament is formed of polyethylene containing a fragrance emitting chemical and said length portions are formed of knitted tubular material which covers said scented filament.

7. A rug according to claim 3, wherein said scented filament is formed of Polyethylene containing a fragrance emitting chemical and said length portions are formed of textile material wrapped around said scented filament for covering said scented filament.

8. A rug according to claim 3, wherein said scented filament is formed of polyethylene containing a fragrance emitting chemical and said length portions are formed of braided material and include said scented filament as a core component therein.

9. A rug according to claim 8, wherein said each of said length portions is formed as a three ply braid covering said scented strand as a core component therein.

10. A rug according to claim 9, wherein each of said length portions has two cores and said scented strand is included in at least one of said cores.

11. A rug comprising a scented filament woven itself as a warp or a filling yarn together with a textile material.

12. A rug according to claim 11, wherein said scented filament is formed of polyethylene containing a fragrance emitting chemical and said filament is disposed in said rug as a filling yarn.

13. A rug according to claim 11, wherein said scented filament is formed of polyethylene containing a fragrance emitting chemical and said filament is disposed in said rug as a warp yarn.

14. A method of manufacturing a scented rug comprising:

forming a plurality of length portions of textile material, while forming at least one of said length portions, disposing a scented filament lengthwise within said length portion and covering said filament with said textile material, said filament extending lengthwise along at least a substantial portion of said length portion, and securing said plurality of length portions side-by-side to form the rug, each said length portion extending between two opposed sides of the rug.

15. A method according to claim 14, wherein said scented filament is formed of polyethylene containing fragrance emitting chemical.

16. A method according to claim 15, wherein said forming comprises braiding.

17. A method according to claim 15, further comprising forming a single length of continuous integrally formed length portions of textile material, said securing comprising securing said length portions of said single length side-by-side to form the rug.

18. A method of manufacturing a scented rug comprising weaving together to form the rug a plurality of warp yarns and a plurality of filler yarns while using a length of a scented filament as one of said yarns.

19. A method according to claim 18, wherein said filament is formed of polyethylene having a fragrance emitting chemical and said filament is woven as a warp yarn.

20. A method according to claim 18, wherein said filament is formed of polyethylene having a fragrance emitting chemical and said filament is woven as a filling yarn.

* * * * *